United States Patent [19]

Ohminato

[11] 4,415,290

[45] Nov. 15, 1983

[54] BINDER ASSEMBLY OF THE RING TYPE

[75] Inventor: Kiyoshi Ohminato, Tokyo, Japan

[73] Assignee: King Jim Co., Ltd., Tokyo, Japan

[21] Appl. No.: 336,305

[22] Filed: Dec. 31, 1981

[30] Foreign Application Priority Data

Jan. 27, 1981 [JP] Japan ..... 56-009231[U]

[51] Int. Cl.[3] ..... B42F 13/12

[52] U.S. Cl. ..... 402/26; 402/41

[58] Field of Search ..... 402/26, 35, 27, 28, 402/29, 30, 34, 48, 70, 38, 41, 36

[56] References Cited

U.S. PATENT DOCUMENTS

| | | | |
|---|---|---|---|
| 2,252,926 | 8/1941 | Hanna | 402/26 |
| 2,318,431 | 5/1943 | Sparks | 402/26 |
| 2,460,718 | 2/1949 | Stevens | 402/26 |
| 2,715,906 | 8/1955 | Lucchesi | 402/20 |
| 3,191,605 | 6/1965 | Cott et al. | 402/26 |

*Primary Examiner*—E. R. Kazenske
*Assistant Examiner*—John S. Brown
*Attorney, Agent, or Firm*—Cantor and Lessler

[57] ABSTRACT

A binder of the ring type includes fixed and pivot rods with their free ends being bent in opposite relation. The pivot rods are attached to a pivot plate. The pivot plate is mounted on a bottom plate in such a manner that it is always biased by a spring in its opening direction. A pivot arm is provided, including an upper member and a lower member formed by bending a metal material. The pivot and bottom plate are clamped between the upper and lower members. To prevent excessive pivot movement of the pivotal arm, a stopper means is provided at the extremity of the pivot end of the pivot arm.

4 Claims, 4 Drawing Figures

BINDER ASSEMBLY OF THE RING TYPE

BACKGROUND OF THE INVENTION

The present invention is concerned with improvements in or relating to the binder assembly of the ring type.

In the conventional binder of the ring type, one of the rings for a pivot rod is made movable and the other made stationary, said one ring being movable by means of a sliding guide having in its one side an inclined guide slot. Such an arrangement is disclosed in, for instance, German Auslegeschrift No. 1 179 539.

However, this known arrangement has a disadvantage that it is quite inconvenient to handle, since a greater force is needed to open or close the ring where there are number of documents held in the binder.

SUMMARY OF THE INVENTION

A main object of the invention is to provide a binder assembly of this type which can be handled in a manner that is surer than ever.

According to the invention, this is achieved by provision of a novel binder assembly of the ring type including fixed and pivot rods which have their free ends being bent in opposite relation, characterized in that said pivot rods are attached to a pivot plate mounted on a bottom plate in such a manner that it is always biased by a spring in its opening direction, and are swung toward said fixed rods by clamping said pivot and bottom plates with a pivot arm, said pivot arm including an upper member and a lower member formed by bending a metal material, between which are clamped said pivot and bottom plates, and a stopper means is provided at the extremity of the pivot end of said pivot arm, said means coming in contact with said bottom plate to prevent excessive pivot movement of said pivotal arm.

BRIEF DESCRIPTION OF THE DRAWINGS

The invention will now be elucidated with reference to a preferred embodiment illustrated in the accompanying drawings, in which.

DETAILED DESCRIPTION OF PREFERRED EMBODIMENT

Figure 1:
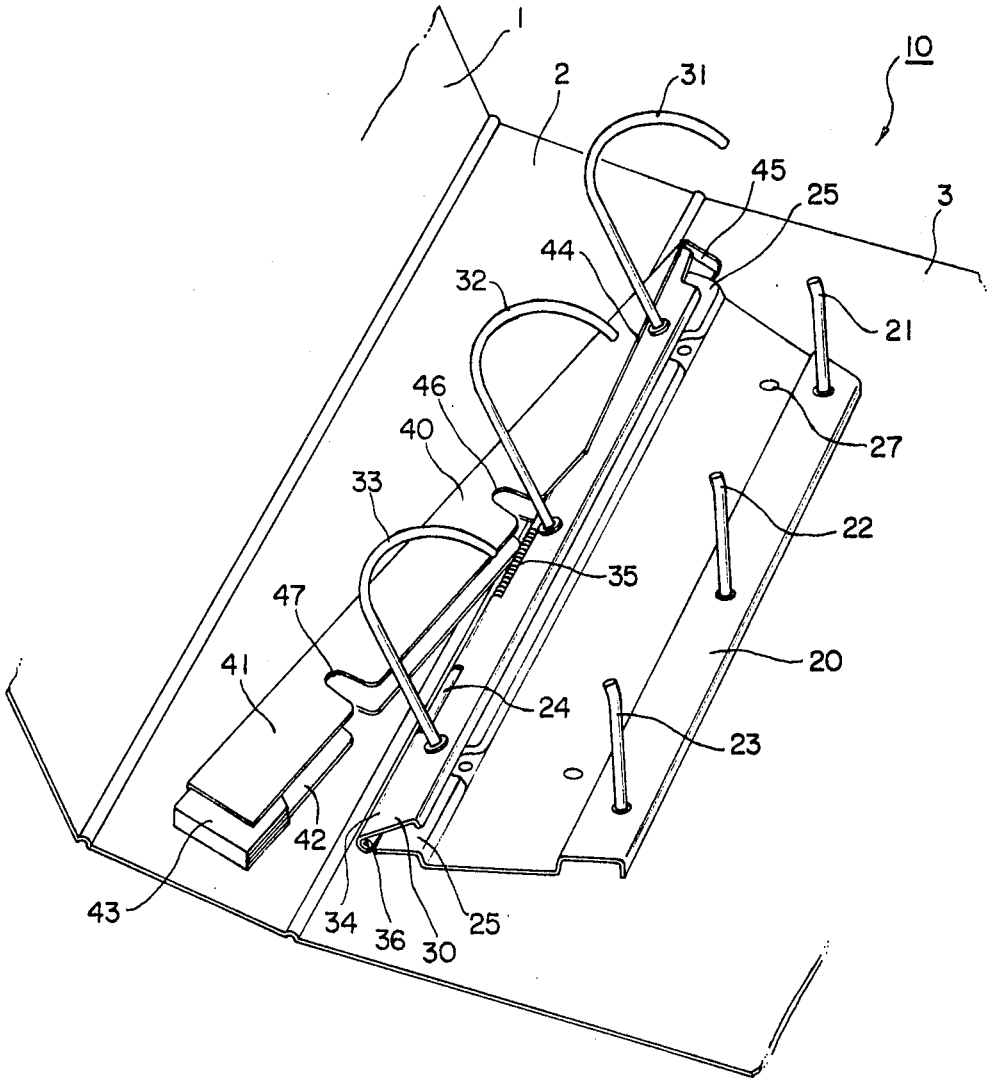
FIG. 1 is a perspective view of one embodiment of the binder assembly according to the invention in its opened state.

Referring to the drawings, in particular to FIG. 1 showing the binder assembly of the ring type according to the invention in its opened state, reference numeral 1 stands for the left cover of a file, 2 for the back or spine thereof, and 3 for the right cover thereof. The binder assembly, generally shown at 10 comprises a bottom plate 20 fixed on the cover 3, a pivot plate 30 mounted on the bottom plate through a spring, and a pivot arm 40 pivotally attached to the bottom plate.

The bottom plate 20 secured to the cover 3 has fixed to it vertical rods 21, 22 and 23 with their free ends being slightly bent toward the pivot rods to be described later. The bottom plate is provided at its side edge with a rounded portion 24 which engages with a rounded portion 34 of the pivot plate. The bottom plate is stepped at 25, and spaced from the right cover at that portion.

The pivot plate 30 is attached to the side edge of the bottom plate, which is opposite to the fixed rods. More specifically, both plates are attached to each other by engaging the rounded part 24 of the bottom plate with the rounded part 34 of the pivot plate and inserting an elongated shaft 36 therebetween thereby forming a hinge. The pivot plate is normally biased by a spring 35 in the counterclockwise direction in FIG. 1, i.e., in its opening direction. As illustrated, the pivot plate is vertically provided with pivot rods 31, 32, and 33 with their free ends being bent in association with the fixed rods.

A pivot arm 40 is mounted on one end of the bottom plate. This arm is formed by bending a metal material, and comprises an upper member 41 and a lower member 42, between which are forcedly inserted the pivot plate 30 and the stepped portions 25 of the bottom plate. The upper member 41 of the arm 40 is cut out at 44. When the pivot arm 40 is swung in the clockwise direction in FIG. 1, i.e., in its opening direction, the pivot plate 30 is swung upwardly under the resiliency of the spring 35 while kept in contact with the cutout 44. This causes turning of the pivot rods 31, 32, and 33 in the counterclockwise direction in FIG. 1, so that the binder is opened.

The pivot arm is provided with a fingertip means 43 at its free end and with a stopper means 45 at its pivot end to prevent excessive pivotal movement. It is noted that reference numeral 27 denotes the head of a rivet for attachment of the plate 20 to the cover 3, which head is preferably flattened to render attachment or detachment of documents easy.

Figure 2:
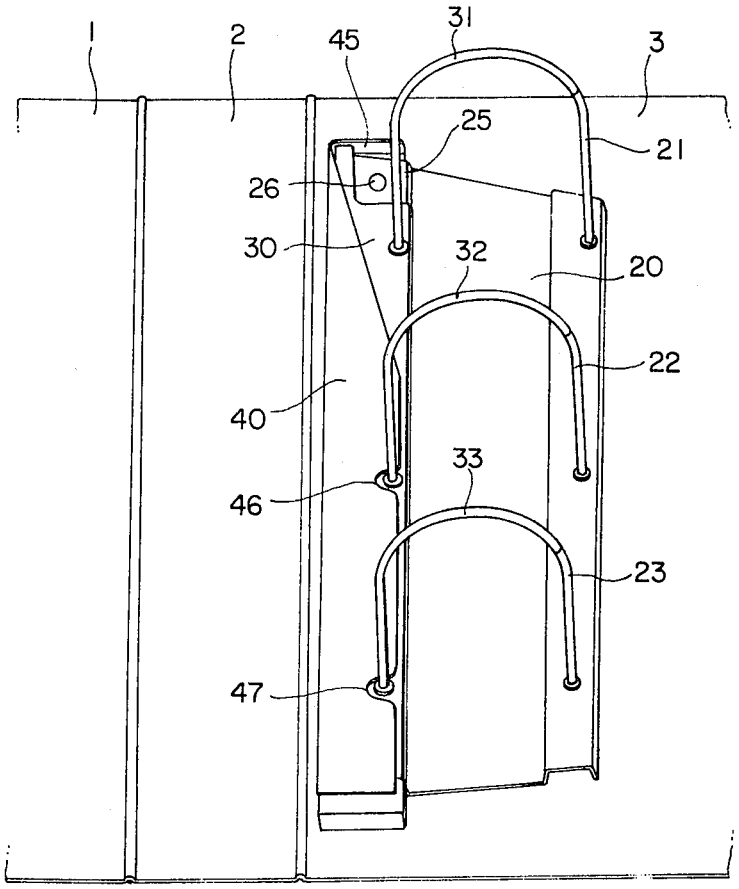
FIG. 2 is a schematic view of this embodiment in its closed state.

FIG. 2 is a schematic view of the binder assembly according to the invention in its closed state. For simplicity of illustration, documents are omitted. As the pivot arm 40 is swung in the counterclockwise direction in FIG. 1 by giving a push on the fingertip means 43, the upper member 41 thereof gives a push on the pivot arm 30 in the clockwise direction in FIG. 2, while the lower member 42 moves into a position below the stepped portion 25 of the bottom plate 20, so that the pivot plate and the bottom plate are forcedly inserted between the upper and lower members. The pivot rods 31, 32, and 33 formed on the pivot plate 30 then turn toward the fixed rods 21, 22, and 23 together with the pivot plate until their free ends are engaged with each other, whereby the binder is closed. It is noted that the pivotal movement of the pivot rods 32 and 33 is smooth owing to the provision of notches 46 and 47, as illustrated. Pivotal movement of the pivot rod 31 is also smooth since the pivotal end of the pivot arm is cut out at 44.

Figure 3:
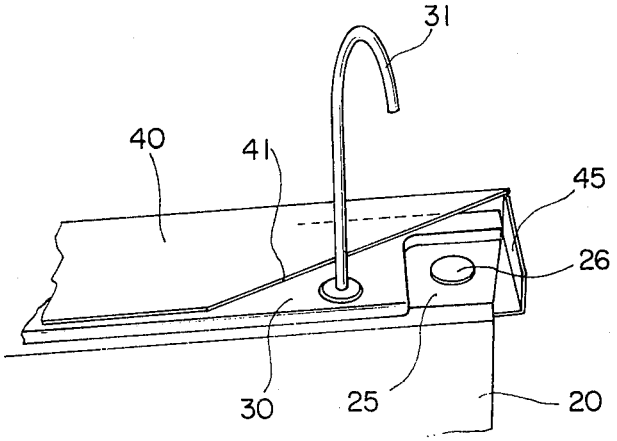
FIG. 3 is a view of the construction of the binder assembly at the pivot end of the pivot plate.
Figure 4:
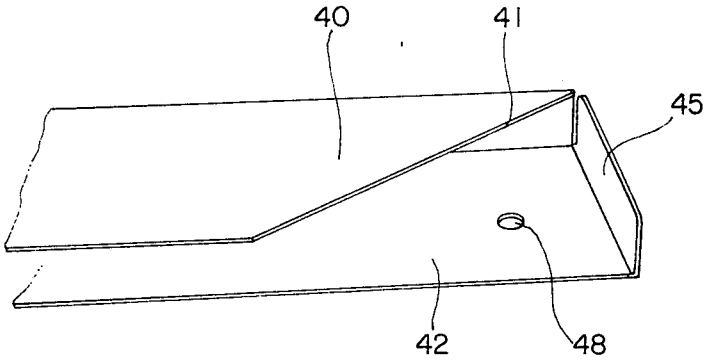
FIG. 4 is a view of the construction of the pivot end part of the pivot plate.

FIG. 3 is indicative of the relationship between the bottom plate 20, the pivot plate 30 and the pivot arm 40, and FIG. 4 is an enlarged view of the pivot end of the pivot arm 40.

In FIG. 3, reference numeral 25 stands for a stepped part of the bottom plate 20, and 26 for the head of a rivet for attachment of the pivot arm 40 to the bottom plate 20. The bottom plate is then covered at the portion except for the stepped part 25 with the bottom plate 30 which is in turn pressed down by the upper member 41 of the pivot arm 40. As mentioned above, the lower member 42 of the pivot arm 40 is positioned below the stepped part 25 of the bottom plate. As illustrated, one end of the pivot plate 30 is bored out to avoid the head 26 of a rivet. In FIG. 4, reference numeral 45 is a stopper means formed by bending an extension of the lower member 42 at the pivot end of the pivot arm. When the pivot arm is swung in the clockwise direction in FIG. 1 to open the binder, such a stopper means 45 abuts upon the side edge of the stepped part 25 of the bottom plate to prevent excessive pivotal movement of the pivot arm. Furthermore, the side edge 28 of the stepped part is inwardly tapered to some extent to permit movement of the stopper means 45. In FIG. 4, reference numeral 48 stands for a hole through which the lower member of the pivot arm 40 is pivotally attached to the stepped part of the bottom plate from below.

What is claimed is:

1. A binder assembly of the ring type including a bottom plate, vertical rods fixed thereto, a pivot plate combined with said bottom plate by a spring, vertical pivot rods fixed to said pivot plate, a pivot arm mounted pivotally at one end thereof on said bottom plate and comprising an upper member and a lower member between which are clamped said bottom and pivot plates, said upper member being diagonally cut away at the pivot end of said arm to permit pivotal movement of said pivot plate when said arm is pivotted, and a stopper means formed at the pivot end of said arm by bending an extension of said lower member.

2. A binder assembly as claimed in claim 1, wherein said pivot plate is normally biased in the upward, open position by said spring.

3. A binder assembly as claimed in claim 1, comprising three fixed and three pivot rods.

4. A binder assembly as claimed in claim 1, further including finger grip means on the end of said arm opposite the pivot end.

* * * * *